United States Patent [19]

Akiba

[11] Patent Number: 4,649,850

[45] Date of Patent: Mar. 17, 1987

[54] METHOD AND APPARATUS FOR MOORING A SHIP IN FRIGID WEATHER CONDITIONS

[75] Inventor: Takehiko Akiba, Saitama, Japan

[73] Assignee: Nippon Kokan Kabushiki Kaisha, Tokyo, Japan

[21] Appl. No.: 726,474

[22] Filed: Apr. 24, 1985

[30] Foreign Application Priority Data

May 17, 1984 [JP] Japan ..... 59-97581

[51] Int. Cl.[4] ..... B63B 21/00

[52] U.S. Cl. ..... 114/230; 414/141

[58] Field of Search ..... 114/230, 270, 221 R; 414/141, 139; 14/71.1, 71.5

[56] References Cited

U.S. PATENT DOCUMENTS

| | | | |
|---|---|---|---|
| 3,145,854 | 8/1964 | Sturm et al. | 14/71.1 |
| 4,011,615 | 3/1977 | Maxson et al. | 14/71.1 |
| 4,369,538 | 1/1983 | Smedal | 414/141 |

*Primary Examiner*—Galen L. Barefoot
*Assistant Examiner*—Jesûs D. Sotelo
*Attorney, Agent, or Firm*—Burgess, Ryan & Wayne

[57] ABSTRACT

A system for mooring a ship in frigid weather conditions includes an enclosed mooring construction in which the winches and/or bollards of a ship are installed in rooms having doors on the ship mooring side. Mooring rooms are provided at a jetty or wharf, and the winches and/or bollards for mooring are installed in the mooring rooms; and the ship mooring room is connected with the jetty mooring room by a trunk, a conveyor being provided in the trunk in order to easily connect a mooring line.

7 Claims, 2 Drawing Figures

METHOD AND APPARATUS FOR MOORING A SHIP IN FRIGID WEATHER CONDITIONS

BACKGROUND OF THE INVENTION

This invention relates to a system of mooring ships and, more particularly, is directed to a system of mooring a ship in cold weather conditions.

Conventional mooring of ships is carried out in the open. However, in a cold environment, the mooring operations, such as delivery of mooring and tug lines, and connection with land equipment, sometimes presents problems which are caused by extremely low temperature and strong winds. As a result, the mooring operation requires much time, and in the extreme case, the mooring operation cannot be performed at all.

OBJECTS AND SUMMARY OF THE INVENTION

It is an object of the present invention to provide a method and apparatus for mooring a ship, which is smoothly and easily carried out in cold weather conditions.

It is another object of the present invention to provide a method and apparatus for mooring a ship, in which the mooring operations are carried out in an enclosed space and outdoor operation is mimimized.

In accordance with an aspect of the present invention, apparatus for mooring a ship comprises, the ship mooring room means having first access means for permitting access to the ship mooring room means during mooring operations; ship mooring means mounted within the ship mooring room means; platform mooring room means mounted on a platform outside of the ship, the platform mooring room means having second access means for permitting access to the platform mooring room means during mooring operations; platform mooring means mounted within the platform mooring room means; conveying means mountable between the ship mooring room means and the platform mooring room means for supplying a mooring line between the ship mooring room means and the platform mooring room means; and at least one of the ship mooring means and the platform mooring means including winch means for tensioning the mooring line between the ship mooring room means and the platform mooring room means.

In accordance with another aspect of the present invention, a method of mooring a ship of the type having ship mooring room means therein with first access means for permitting access to the ship mooring room means during mooring operations, and ship mooring means mounted within the ship mooring room means, the method comprising the steps of moving the ship alongside a platform having platform mooring room means mounted thereon, the platform mooring room means having second access means for permitting access to the platform mooring room means during mooring operations, and platform mooring means mounted within the platform mooring room means, at least one of the ship mooring means and the platform mooring means including winch means; positioning conveying means between the ship mooring room means and the platform mooring room means; supplying a mooring line between the ship mooring room means and the platform mooring room means by the conveying menas; and tensioning the mooring line between the ship mooring room means and the platform mooring room means by the winch means to moor the ship.

These and other objects of the invention will be more clearly understood by reference to the following description, taken together with the drawings embodying the invention.

DETAILED DESCRIPTION OF PREFERRED EMBODIMENTS

Figure 1:
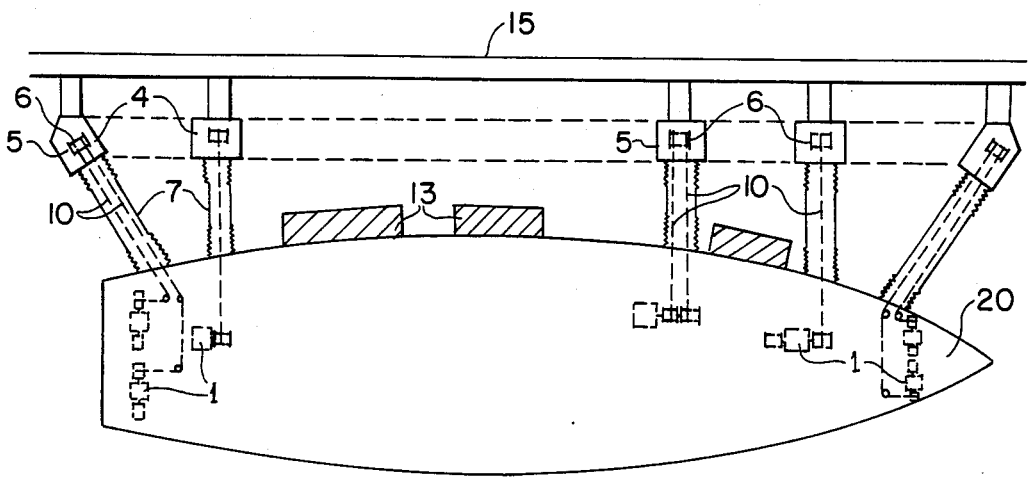
FIG. 1 is a schematic, plan view of one embodiment of the present invention, illustrating operation of the system.

Referring to the drawings in detail, winches 1 are installed in mooring room 2 arranged inboard of a ship, and a watertight door 3 is provided on an outside wall of each room 2.

Outside of ship 20, platforms 4 are constructed jutting out from a jelly 15 into the sea at suitable intervals, and a mooring room 5 is built on each platform 4, each room 5 having a watertight door 14. Each winch 6 of the moorage side is installed in a respective mooring room 5.

Each room 2 of the ship side is connected with a respective mooring room 5 by a mooring trunk 7. Both ends 8, 8 of mooring trunk 7 are open, and a flexible bellows device **8*a* is attached to each end 8 in order to absorb rocking movements and to account for misalignment of the ship and the berth. A flange 9 fitted with quick couplers is attached to the end of each bellows device 8*a*. A conveyor 11 transferring a mooring line 10 is provided in trunk 7. As shown in FIG. 1, mooring line 10 may be a single line, double line or more. Each trunk 7 is mounted or hung by a crane 12 which is installed on the respective platform 4 and which is operated by remote control. Crane 12 may be of the fixed or mobile type, and the size, capacity and the like can vary in accordance with the weight of trunk 7**.

Figure 2:
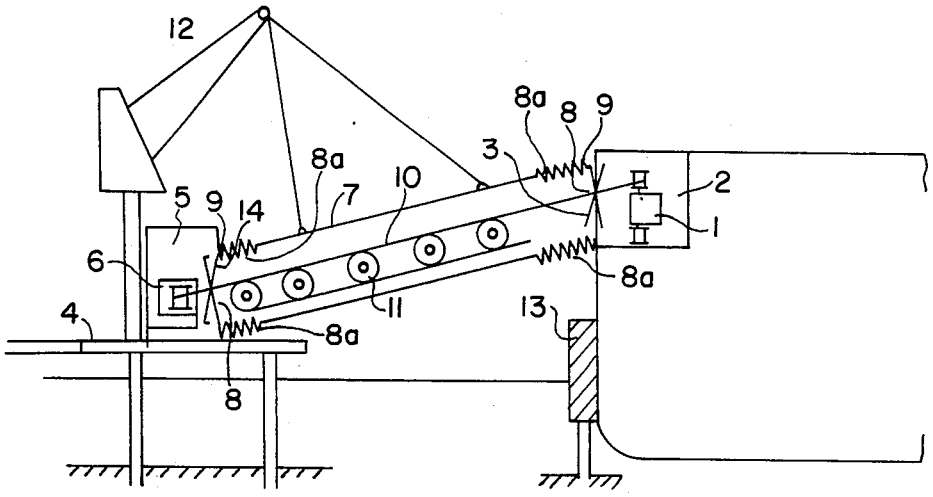
FIG. 2 is a schematic, cross-sectional side view of the apparatus of FIG. 1.

During the mooring process, ship 20 having the above-mentioned rooms 2 first comes alongside fenders 13 which are illustrated in FIGS. 1 and 2. Each trunk 7 is carried to the prescribed position by crane 12, and doors 3 and 14 of mooring rooms 2 and mooring rooms 5, respectively, are opened. Mooring rooms 2 and 5 are connected by trunk 7 using the quick couplers of flanges 9. Subsequently, a messenger wire or rope is sent from the ship side or the moorage side by conveyor 11, whereby mooring line 10 is set between winch 1 of a room 2 and winch 6 of the respective mooring room 5, led by this messenger wire or rope. Then, mooring line 10 is tensioned by winches 1 and 6. The five mooring arrangements illustrated in FIG. 1 are successively put into operation in such a manner, whereby the ship becomes moored.

The system of the invention is not limited to the above embodiment, and various modifications may be provided. For example, a bollard may be substituted for either one or both of winches 1 and 6. Also, mooring trunk 7 may be a cylindrical tube or a square duct; the bellows device **8*a* may be attached to only one end 8 of trunk 7, whereby the weight of this trunk 7 is reduced. Trunk 7 may further be movable vertically and horizontally by itself instead of requiring assistance from crane 12. In the case where the entire body of trunk 7 is elastic, the aforementioned connection of trunk 7 may be carried out by expanding it. Such an elastic body may be formed by bellows devices or multiple trunk members which are telescopically connected. It will be appreciated that such elastic or telescopic trunk 7 may be equipped in each room 2 of ship 20 instead of mooring rooms 5. Of course, conveyor 11 provided in trunk 7** may be replaced by rollers or pulleys.

In regard to possible misalignment or the like, each mooring room 5 may be rotatable in order to adjust the position of the respective door 14 thereof towards the connecting direction with ship 20. Further, some or all of mooring rooms 5 may be connected with each other; or alternatively, mooring rooms 5 may be incorporated into a single building. Also, mooring rooms 2 and 5 may be provided with a heating system for improvement of the environment for mooring operations.

Of course, the size and number of the mooring arrangements and the interval spacing therebetween are determined according to the size of the ships to be moored. The type of ships to be moored is not limited, however, and may include, for example, without limitation, an oil tanker, an LNG tanker, an ore carrier, an ice breaker, and the like.

According to the mooring system of the invention, the mooring and unmooring operations of a ship can easily and surely be carried out even under severely cold weather conditions. Obstruction by iceing can also be avoided. Connecting and disconnecting of the mooring lines are easily and smoothly performed by the conveyor in the trunk.

Having described preferred embodiments of the invention with reference to the accompanying drawings, it will be understood that the present invention is not limited to those precise embodiments, and that various changes and modifications may be effected therein by one of ordinary skill in the art without departing from the scope or spirit of the present invention as defined by the appended claims.

What is claimed is:

1. Apparatus for mooring a ship adjacent a platform in frigid weather conditions, comprising:

fender means for aligning said ship with respect to said platform;

ship mooring room means within said ship, said ship mooring room means having first access means for permitting access to said ship mooring room means during mooring operations;

ship mooring means mounted within said ship mooring room means;

platform mooring room means mounted on said platform outside of said ship, said platform mooring room means having second access means for permitting access to said platform mooring room means during mooring operations;

platform mooring means mounted within said platform mooring room means;

trunk means detachably connectable between said ship mooring room means and said platform mooring room means;

conveying means mountable within said trunk means between said ship mooring room means and said platform mooring room means for supplying a mooring line between said ship mooring room means and said platform mooring room means; and at least one of said ship mooring means and said platform mooring means including winch means for tensioning said mooring line between said ship mooring room means and said platform mooring room means.

2. Apparatus according to claim 1; further comprising flexible bellows means secured to at least one end of said trunk means.

3. Apparatus according to claim 1; wherein said trunk means is at least partially elastic.

4. Apparatus according to claim 1, further including crane means for positioning said trunk means between said ship mooring room means and said platform mooring room means.

5. A method of mooring a ship of the type having ship mooring room means therein with first access means for permitting access to said ship mooring room means during mooring operations, and ship mooring means mounted within said ship mooring room means, said method comprising the steps of:

moving said ship alongside a platform having platform mooring room means mounted thereon, said platform mooring room means having second access means for permitting access to said platform mooring room means during mooring operations, and platform mooring means mounted within said platform mooring room means, at least one of said ship mooring means and said platform mooring means including winch means;

aligning said ship with respect to said platform by fender means;

positioning trunk means having conveying means therein between said ship mooring room means and said platform mooring room means;

supplying a mooring line within said trunk means and between said ship mooring room means and said platform mooring room means by said conveying means; and tensioning said mooring line between said ship mooring room means and said platform mooring room means by said winch means to moor said ship.

6. A method according to claim 5; wherein said trunk means includes flexible bellows means secured to at least one end thereof, and wherein said step of positioning said trunk means includes the step of correcting misalignment of said trunk means by said flexible bellows means.

7. A method according to claim 5; further including the step of so positioning said trunk means by crane means.

* * * * *